United States Patent [19]

Vrijssen et al.

[11] 4,182,973

[45] Jan. 8, 1980

[54] ELECTRIC DISCHARGE TUBE

[75] Inventors: Gerardus A. H. M. Vrijssen; Franciscus C. M. De Haas, both of Eindhoven, Netherlands

[73] Assignee: U.S. Philips Corporation, New York, N.Y.

[21] Appl. No.: 836,528

[22] Filed: Sep. 26, 1977

[30] Foreign Application Priority Data

Feb. 12, 1976 [NL] Netherlands ..... 7613412

[51] Int. Cl.[2] ..... H01J 29/46

[52] U.S. Cl. ..... 313/456; 313/482

[58] Field of Search ..... 313/378, 383, 390, 451, 313/456, 417, 448, 449, 482

[56] References Cited

U.S. PATENT DOCUMENTS

| | | | |
|---|---|---|---|
| 2,219,111 | 10/1940 | Nicoll | 313/456 |
| 2,400,332 | 5/1946 | Bachman | 313/482 |
| 4,017,878 | 4/1977 | Hagiwara | 350/257 X |

*Primary Examiner*—Robert Segal
*Assistant Examiner*—Darwin R. Hostetter
*Attorney, Agent, or Firm*—Algy Tamoshunas

[57] ABSTRACT

Disclosed is a bayonet catch for directly securing an electrode in a glass envelope which comprises projections extending inwardly from the envelope and radially extending portions on the electrode which are clamped between the projections upon rotation of the electrode. The material of the envelope and the electrode have substantially equal coefficients of expansion to minimize relative movement between the envelope and the electrode with changes in temperature.

7 Claims, 6 Drawing Figures

ELECTRIC DISCHARGE TUBE

Figure 1:
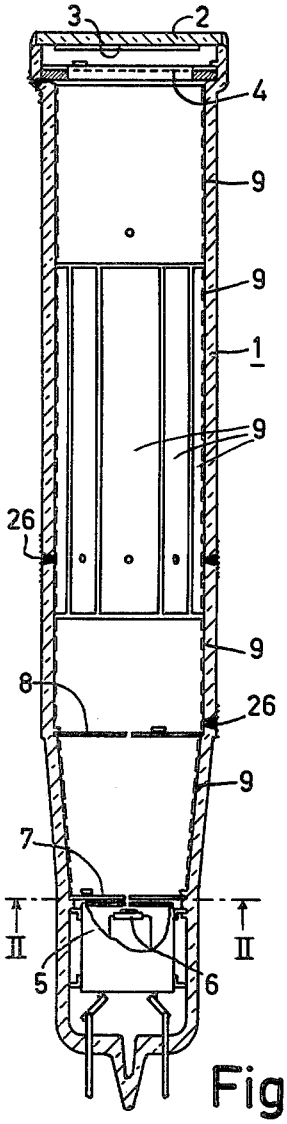

The invention relates to an electric discharge tube comprising a glass envelope at least a portion of which has a cylindrical internal wall. An electrode is secured in the cylindrical portion of the envelope by means of a bayonet catch comprising projections extending inwardly from the wall of the envelope.

Such a tube is disclosed in U.S. Pat. No. 2,171,766 in which the electrodes are secured in the tube envelope by means of springs which can be kept in place by means of a bayonet catch. This method of securing the electrode is not accurate since the springs, especially after heating, do not always return to the same position. Moreover, the springs require much space in the tube and as a result of their large surface area contribute, by giving off gas, to deterioration of the vacuum in the tube.

British Patent Specification No. 587,236 discloses a tube whose envelope has a number of inwardly extending projections with a mica plate provided therebetween. The mica plate is introduced into the envelope in a curved position after which it engages between the projections and becomes flat. An electrode is secured to the mica plate. This also is an inaccurate method which is not suitable for television camera tubes, display tubes and the like, in which the electrodes of the electrode system have to be aligned accurately with respect to each other.

British Patent Specification No. 507,840 describes how a complete electron gun consisting of a number of electrodes which are connected together by assembly rods can be centred and secured in an envelope. For that purpose, a number of mica disks having radial projections are secured to the assembly rods of the electron gun. The envelope has in a number of places depressions which are equally spaced from the axis of the envelope. The depressions are provided with V-shaped grooves in which the mica plates are clamped. This method is not very accurate either.

It is an object of the invention to provide an electric discharge tube in which an electrode may be secured very accurately and directly in the envelope without the need of springs, mica plates or assembly rods.

According to the invention, an electric discharge tube of the kind mentioned in the preamble is characterized in that the electrode has a plurality of rim portions extending radially outwards, substantially in a plane normal to the axis of said portion. The electrode is secured in the envelope by rotating it so that each of the rim portions is engaged between the projections. The electrode is made from a material with a coefficient of expansion equal to, or substantially equal to, the coefficient of expansion of the glass of the envelope.

The bayonet catch is preferably characterized in that the projections have a circumferentially projecting ridge and at least two cams. The cams have a minimum distance to the ridge which is substantially equal to or is smaller than the thickness of the rim portions of the electrode and one side of the cams rises towards the ridge.

In a preferred embodiment the glass of the tube envelope has a coefficient of expansion between $5.10^{-7}$/°C. and $120.10^{-7}$/°C. and the material of the electrode has a coefficient of expansion which is equal to or substantially equal to the coefficient of expansion of the glass. It is possible, for example, to use conventional electrode materials, for example, CrNi-steel, with a glass having a coefficient of expansion adapted thereto.

It has been found that projections with a height from 10 to 80 μm are sufficient provided the glass of the envelope and the material of the electrode are correctly chosen to accurately keep the electrode in its place between the projections during and after a degassing temperature treatment.

The projections can be formed by means of a number of glass processing techniques, such as etching or moulding. However, the projections are preferably formed by sucking on a mandril as described in Netherlands Patent Specification No. 911 and U.S. Pat. No. 2,531,394. The mandril which has recesses to form the projections should shrink upon cooling to such an extent that it can be pulled out of the envelope. This is very readily possible with projections of 10 to 80 μm.

In order to be able to easily assemble a number of electrodes in the envelope one after the other, the envelope may be longitudinally tapered or stepped.

Electrodes secured to an envelope in this manner are particularly suitable for use in combination with thin-film electrodes on the wall of the envelope. In this manner, for example, a completely electrostatic camera tube can be manufactured. Because the sucked-on glass tubes are accurately circular and straight and the axial spacing of the projections is accurate, it is possible to manufacture accurate and identical electron tubes. The usual comparatively thick anode sleeves are no longer necessary so that less gas is given off and hence fewer emission problems will occur after many hours of operation.

Figure 2:
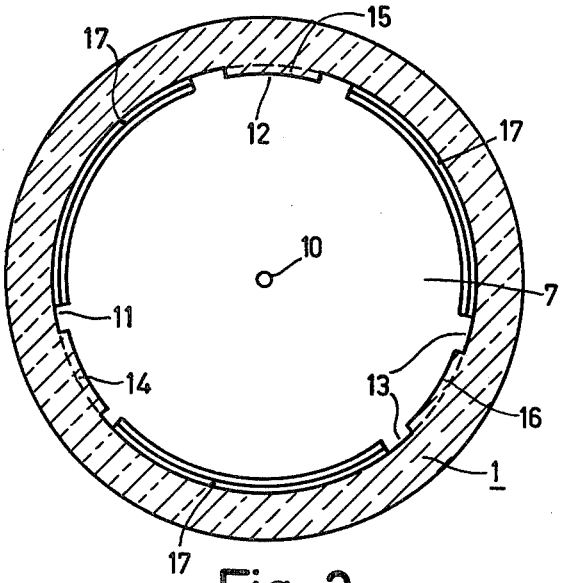
Figure 4:
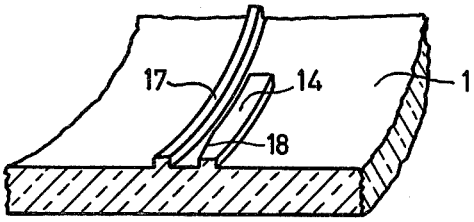
Figure 3:
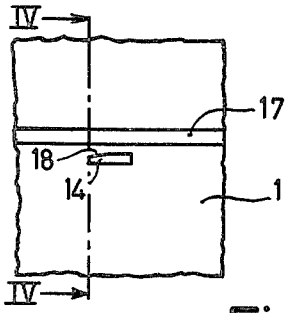
Figure 5:
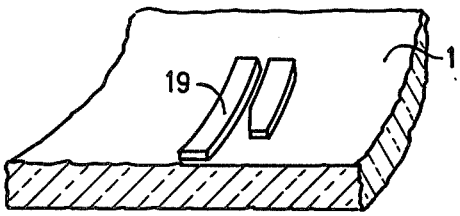
Figure 6:
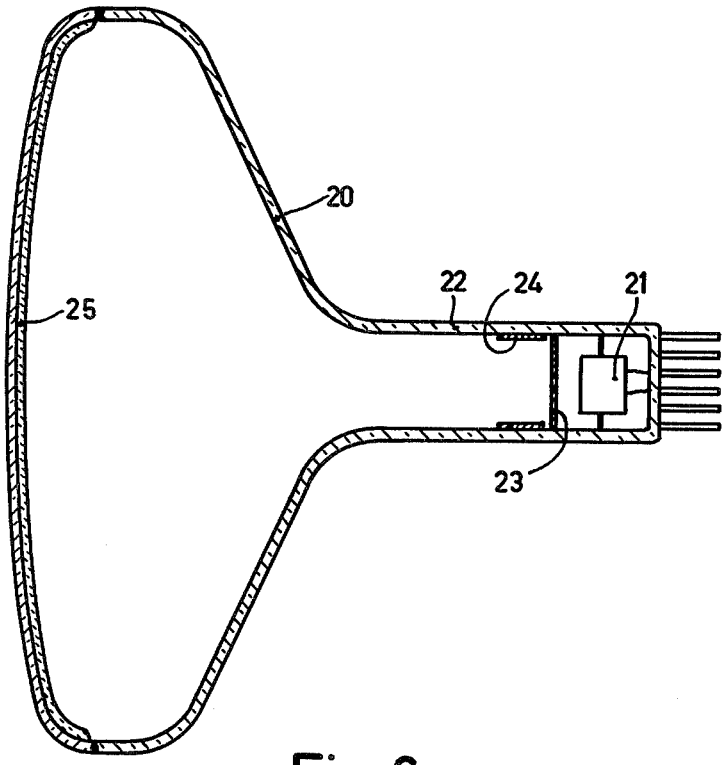

The invention will now be described in greater detail with reference to the drawing, in which:

FIG. 1 shows in a longitudinal view, mainly sectional and partly cut away, a television camera tube with electrodes connected according to the invention, FIGS. 2 and 3 show the electrode connection according to the invention in an axial cross-section and a fragmentary view FIGS. 4 and 5 show two possibilities in fragmentary view of the bayonet catch, according to the invention and FIG. 6 shows a television display tube with electrodes secured according to the invention.

FIG. 1 shows a television camera tube having a number of electrodes which are secured to the cylindrical glass envelope 1 in the manner described above. The envelope is closed by means of a window 2 which is provided with a photoconductive layer 3. In front of layer 3 is a gauze-like electrode 4. The tube also includes a Wehnelt cylinder 5, a cathode 6, an anode plate 7 and a diaphragm 8 which, together with the thin-film electrodes 9, form the electron gun. The thin-film electrodes 9 can be supplied with the desired voltage by means of lead-throughs 26.

FIG. 2 is a cross-sectional view of the tube shown in FIG. 1. The anode plate 7 is provided with an aperture 10 through which passes the electron beam originating from the cathode. The anode plate 7 has three radially extending rim portions 11, 12 and 13 spaced at intervals of 120° around its periphery. The rims are clamped in gaps between the cams 14, 15, 16 and the ridge 17 extending from the envelope. The anode plate 7 is made from molybdenum and has a thickness of 0.2 mm. The envelope is made from a glass having a coefficient of expansion of $5.10^{-6}$/°C.

FIG. 3 shows how one of the cams 14 is situated opposite to the ridge 17. Cam 14, as well as the other cams, has a rising side 18 on the side of the ridge 17. The electrode 8 is mounted in the envelope 1, by inserting it into the envelope with the rim portions 11, 12 and 13 and is then rotated anticlockwise. As a result of the rising sides 18, the rim portions 11, 12 and 13 of the electrode are clamped against the ridge 17. Since the expansion of the electrode is substantially equal to that of the envelope, the electrode 8 will remain in the correct position during operation of the tube.

FIG. 4 is a perspective sectional view of the wall portion shown in FIG. 3. As a result of the small difference in coefficients of expansion of the glass of the envelope 1 and the plate 7, the cams 14, 15 and 16 and the ridge 17 can have a height of only 20 μm.

FIG. 5 shows that the ridge 17 may be replaced by cams 19 which may be provided with a rising side.

The invention is not restricted to camera tubes but may also be used in other electric discharge tubes, for example television display tubes.

FIG. 6 shows a display tube comprising, in a glass envelope 20, means 21 for generating an electron beam which are secured in the neck 22 of the envelope. The accelerating electrode 23, which is secured in the tube in accordance with the invention, cooperates with a thin-film electrode 24, consisting, for example, of a thin metal layer which is vapour-deposited on the inner wall of the neck 22 of the display tube and forms an electron beam which is focused on the display screen 25 and can be deflected in the usual manner.

What is claimed is:

1. An electric discharge tube comprising a glass envelope having a cylindrical inner wall portion, an electrode and means for securing said electrode in said envelope, said means including a plurality of rim portions on said electrode extending radially toward said wall portion in a plane normal to the axis of said cylindrical wall portion and a plurality of spaced apart projections extending from said wall portion and defining a plurality of grooves therebetween spaced about the circumference of said wall portion, one of the projections defining a respective one of said grooves having a side wall portion adjacent and spaced from the other projection defining said one groove a distance substantially equal to or less than the thickness of said rim portions and a second side wall portion which is inclined at an angle from said other projection such that the spacing therebetween decreases toward said first-named side wall portion so that a respective one of said rim portions is received and firmly clamped between said projections upon rotation of said electrode about said axis, said electrode being made of a material having a coefficient of expansion substantially equal to the coefficient of expansion of the glass of said envelope to minimize relative movement between said electrode and said envelope upon change in temperature.

2. An electric discharge tube as claimed in claim 1 wherein said other projection extends about the circumference of said inner wall portion and said securing means includes at least two of said one projections spaced about the circumference of said inner wall portion.

3. An electric discharge tube as claimed in claim 1, wherein said glass of said envelope has a coefficient of expansion between $5\times10^{-7}$/°C. and $120\times10^{-7}$/°C.

4. An electric discharge tube as claimed in claim 1, wherein the height of the projections is between 10 and 80 μm.

5. An electric discharge tube as claimed in claim 1, wherein said envelope with said projections is formed by suction on a profiled mandril.

6. An electric discharge tube as claimed in claim 1, wherein the envelope is tapered in the longitudinal direction.

7. An electric discharge tube as claimed in claim 1, including a thin-film electrode provided on the wall of the envelope which cooperates with said first-named electrode to form an electrode system.

* * * * *